US005922412A

United States Patent [19]

Baughman et al.

[11] Patent Number: 5,922,412

[45] Date of Patent: Jul. 13, 1999

[54] METHOD OF ELIMINATING UNEVENNESS IN PASS-REVERSAL THERMAL SPRAYING

[75] Inventors: James Richard Baughman, Plymouth; David James Cook, Farmington Hills, both of Mich.

[73] Assignee: Ford Global Technologies, Inc., Dearborn, Mich.

[21] Appl. No.: 09/048,267

[22] Filed: Mar. 26, 1998

[51] Int. Cl.[6] ..... C23C 4/12

[52] U.S. Cl. ..... 427/449; 427/456; 427/233; 427/236

[58] Field of Search ..... 118/318, 323; 427/456, 233, 236, 449

[56] References Cited

U.S. PATENT DOCUMENTS 2,754,227 7/1956 Ransburg ..... 118/323
4,664,587 5/1987 Case, Jr. et al. .
5,514,422 5/1996 McCune .
5,691,004 11/1997 Palazzolo et al. ..... 427/456
5,723,187 3/1998 Popoola et al. ..... 427/453

*Primary Examiner*—Katherine A. Bareford
*Attorney, Agent, or Firm*—Joseph W. Malleck

[57] ABSTRACT

A method of eliminating unevenness in pass-reversal thermal spraying of a substrate surface by: uniformly thermally spraying a substrate surface by moving a wire fed arc spray gun along the length of the substrate surface at constant spray parameters while using a first wire feed rate and a first current level for the gun's power supply; (b) when said spray gun approaches an end zone of the pass length requiring reversal of spray gun movement, reducing the wire feed rate and current by up to about 25% until the spray gun has completed such reversal and has exited from said end zone in the opposite direction; (c) while still continuing thermal spraying, restoring the wire feed rage and current to said first levels; and (d) repeating steps (b) and (c) as the spray gun approaches other or repeated end zones of the substrate length during repeated passes.

5 Claims, 2 Drawing Sheets

METHOD OF ELIMINATING UNEVENNESS IN PASS-REVERSAL THERMAL SPRAYING

BACKGROUND OF THE INVENTION

This invention relates to the technology of thermal spraying and more particularly to the technology of varying the parameters of spraying while controlling spray gun movement to effect variations in the metal deposit.

DESCRIPTION OF THE PRIOR ART

Thermal spray guns are conventionally supported and moved at a uniform speed and at uniform spray parameters. Accordingly, thermal spray guns are used to deposit a layer of sprayed material in a relatively thin layer to avoid concentrating undue heat in the target areas. To build a greater thickness of the coating, several passes of the spray gun are necessary. If the gun is immediately reversed in its uniform linear travel precisely at the end of the surface to be coated, a non-uniform bulge will occur in the coating at such reversal edge. Excess material is laid down at such reversal edge as the result of the slowing down of the gun to make the reversal. This bulge is disadvantageous because (i) it introduces greater heat to the coating at such bulge, leading to "hot spots" or residual thermal stress, (ii) the bulging can lead to disbonding as a result of an excessive shrinkage rate in the coating when the gun spray moves away.

An attempt to overcome this problem comprises use of extended travel of the gun, well beyond the target zone for the coating, before reversing the gun travel. This results in considerable waste of spray material. When spraying complicated structural substrates that cannot tolerate the presence of a coating outside the target zone, one must, either (i) use expensive masking to prevent contaminating such other parts of the product or assembly that are not to be coated, (ii) use a release agent as well as tedious cleaning of the adjacent surfaces to remove the unwanted coating (cleaning is essential to remove the risk of loose particles adjacent and outside the edge of the target area, which particles may break loose and contaminate other moving parts of the assembly).

SUMMARY OF THE INVENTION

To overcome such problems, the method of this invention provides for eliminating unevenness in pass-reversal thermal spraying of a substrate surface by the following series of steps: (a) uniformly thermally spraying a substrate surface by moving a wire fed arc spray gun along the length of the substrate surface at constant spray parameters while using a first wire feed rate and a first current level for the gun's power supply; (b) when said spray gun approaches an end zone of the pass length requiring reversal of spray gun movement, reducing the wire feed rate and current by up to about 25% until the spray gun has completed such reversal and has exited from said end zone in the opposite direction; (c) while still continuing thermal spraying, restoring the wire feed rate and current to said first levels; and (d) repeating steps (b) and (c) as the spray gun approaches other or repeated end zones of the substrate length during repeated passes.

DETAILED DESCRIPTION AND BEST MODE

This invention contemplates controlling the spray parameters in such a manner that reversal of a traverse mechanism for the gun can take place at the immediate extreme end of the substrate without experiencing a tapered increase (bulge) in the thickness of the coating. The spray parameters that may be of interest to modify the volume of sprayed material include: (i) the amount of electrical current applied to the electrodes of the gun, (ii) the rate at which wire is fed through the melting zone of the gun, (iii) the pressure of the gas administered to the gun to create a plasma, (iv) the pressure of the air supply used to shroud or intersect with the plasma, and (v) the traverse mechanism slide rate. Two of such parameters are essential and must be controlled to at least obtain a variance in spray volume: electrical current and wire feed rate.

Figure 1:
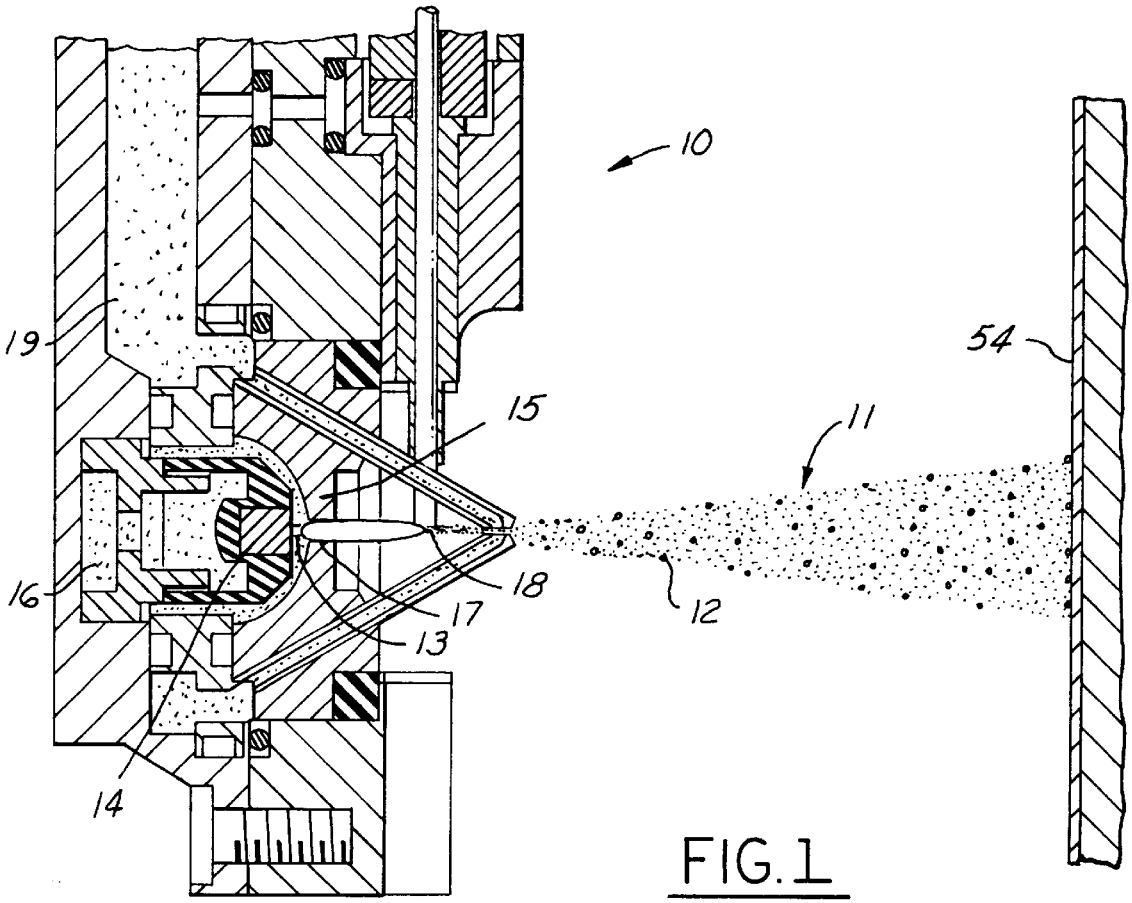
FIG. 1 is an enlarged view of the spray head of a wire arc spray gun illustrating how the metal spray pattern is created.

This invention is directed to the use of an electric wire arc spray gun, preferably of the type described in U.S. patent application Ser. No. 08/799,242 filed Feb. 14, 1997, now U.S. Pat. No. 5,808,270 and commonly owned by the assignee of this invention. As shown in FIG. 1, such electric wire spray gun head 10 creates a spray 11 of molten metal droplets 12 by first establishing an arc 13 between a cathodic electrode 14 and an anodic nozzle 15; the electrodes are supplied with D.C. electrical power at a current within the range of 20–200 amps and a voltage in the range of 80–320 volts. A plasma creating gas 16 (such as air, nitrogen or argon, possibly mixed with some hydrogen or helium) at a pressure of about 20–150 psig, is directed through the arc 13 to be instantaneously heated to a temperature that creates a stream of hot ionized electrically conductive gas, plasma 17. To extend the plasma plume, the arc is transferred from the electrode 14 past the nozzle 15 to a continuously fed wire tip 18. Secondary gas 19, preferably air, at a pressure of 50–120 psi is funneled around the plasma plume to converge and intersect the spray 11 to accelerate, atomize and shroud the metal droplets.

Figure 2:
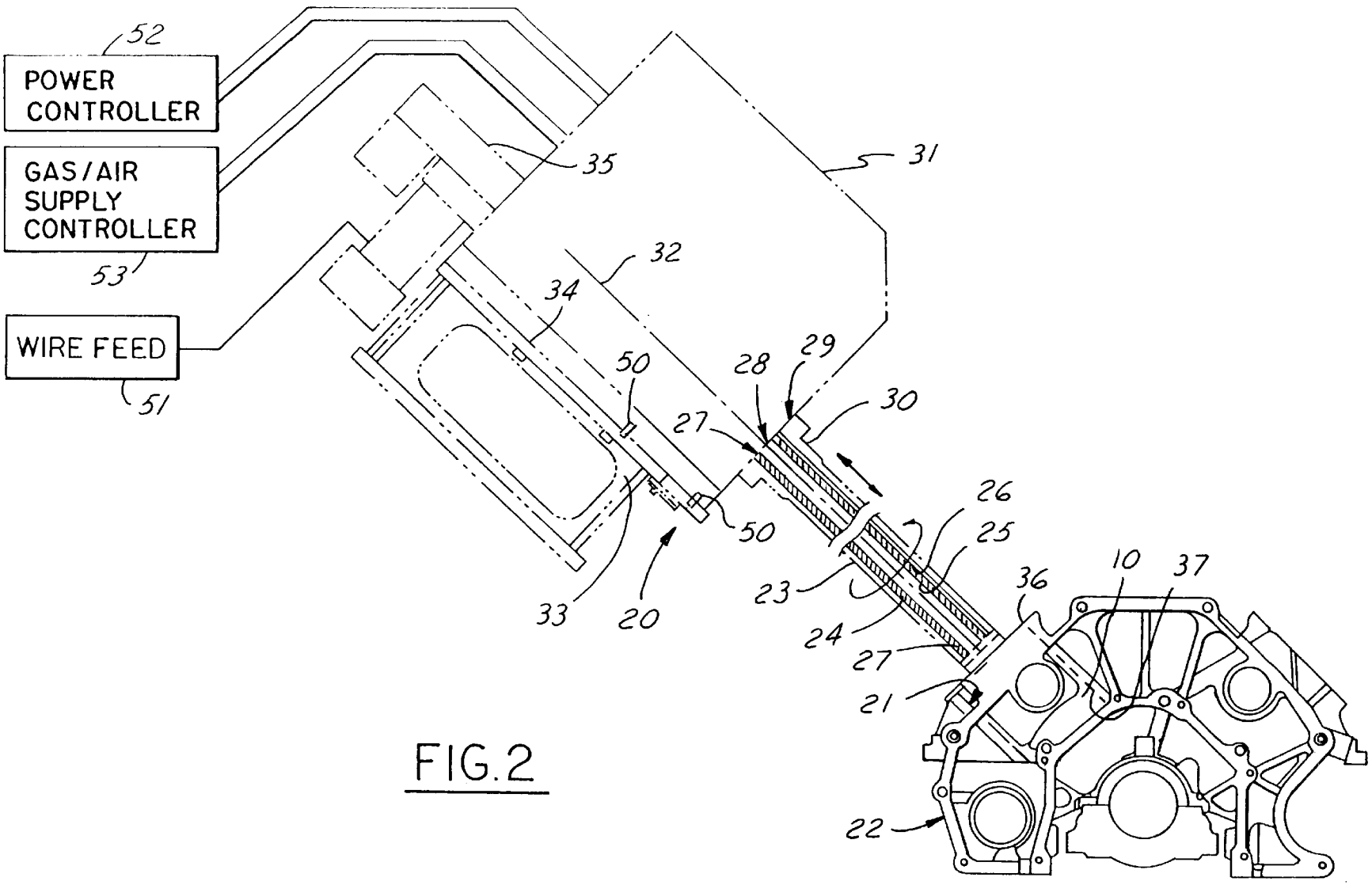
FIG. 2 is a diagrammatic view of the apparatus elements that are used in multi-layering spraying in accordance with this invention illustrating a constant traverse of a rotary mechanism for the spray gun, as well as controls for varying the spraying parameters to result in a reduction of the volume of sprayed material adjacent the end zones of the pass length.

The mechanism 20 for supporting and moving the wire arc spray gun head 10, as shown in FIG. 2, facilitates coating the interior walls 21 of cylinder bores of an internal combustion engine block 22. Mechanism 20 may comprise a spindle 23 supporting the spray head 10 at one end and which spindle contains channels 24, 25, 26 for respectively supplying wire 27, plasma gas 28 and secondary gas 29 to the spray head. The spindle 23 is supported at its opposite end 30 by a rotary drive 31 to rotate the spindle either about its own axis 32 or an axis parallel thereto. The rotary drive 31 is in turn supported on a lineal traverse mechanism or slide 33 that moves the rotary drive up and down a track 34 by action of a ball-screw type mechanical drive 35 (such latter drive converting rotary action of an electric motor to linear motion by intermeshing worn gears). Thus, the spray head 10 (while rotating) is moved up and down within the cylinder bore, reversing its linear direction at the edges 36, 37 of the cylinder bore wall, thereby building up a multi-layered coating 38.

Figure 3:
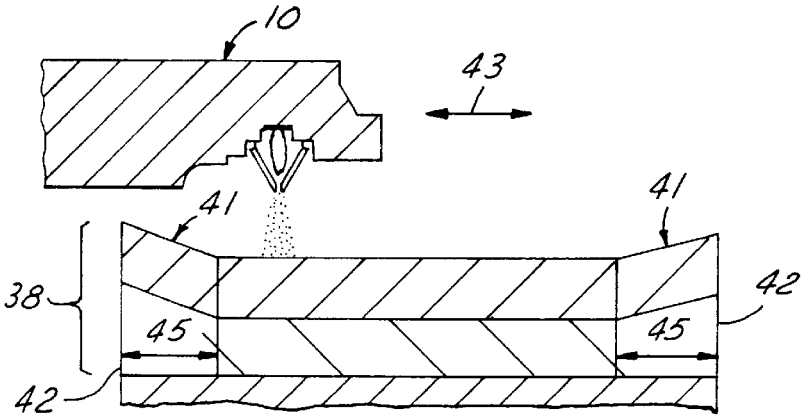
FIG. 3 is a diagrammatic view of multi-layering to build up a thermal spray coating when using constant spray parameters throughout the multi-layering.
Figure 4:
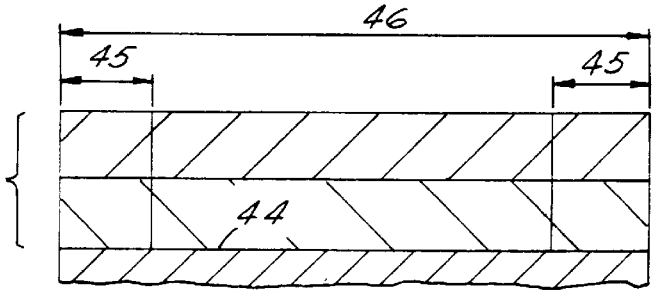
FIG. 4 is another diagrammatic view of multi-layering that is uniform in thickness from edge to edge as a result of varying the spray diameters in accordance with this invention.

If multiple passes of the spray head 10 were used to build up a multi-layer coating 38 and the spraying parameters for the gun are kept constant throughout the several passes (as is conventional according to the practice of the state of the art) there will be a bulge or taper 41 occurring in the coating at the end zones 45 adjacent the coating edges 42 where reversal of the direction of gun movement 43 takes place (see FIG. 3). To overcome this problem, this invention contemplates modifying the spraying parameters to reduce the volume of sprayed material hitting the substrate 44 at the end zones 45 of the pass length 46. When the traverse mechanism has moved the spray 11 to a position where it begins to enter an end zone 45, a position sensor 50 on the mechanism 20 will cause the drive 35 to begin to reverse; this requires a slowing down and reversal of the mass of the gun which may or may not be linear. Such slowing down will inherently deposit greater material and import greater deposit heat. To overcome this, at least the control 51 for the wire feed is adjusted and the control 52 for the electrical power is also adjusted. The current and wire feed rate are reduced in one or more increments up to about 25% of the value of the parameters at normal constant values used before the reversal zone is approached. The net effect will be to lay down coating layers that have roughly a uniform thickness continuously there across to the exact edges 42 of the target substrate surface with no over spray (see FIG. 4).

The inventive method herein therefore comprises: uniformly thermally spraying the substrate surface 44 by moving the spraying gun traverse mechanism 20 so that the spray 11 moves along the length 46 of the substrate at constant spray parameters (at least a first wire feed rate and a first current level from the power supply 52 are constant); continuing to thermally spray at such constant spray parameters except when the spray begins to enter an end zone 45. A position sensor 50 is used to trigger reversal of the traverse mechanism direction while reducing the wire feed rate and current about 25% below the first levels. The volume of sprayed material is proportionately reduced. The reduction in parameters is continued until the traverse mechanism has exited from the zone in the opposite direction. Thereafter, the spraying parameters are increased (including the wire feed rate and current level) back to the first values after the traverse mechanism 20 has left the end zone and spraying is continued at such values until another end zone of the substrate is approached and entered, whereby the initial steps are repeated.

If the coating is a bond coating applied directly to the substrate, such as the internal wall of a cylinder bore of an aluminum engine block, the substrate should be caustically cleaned and preferably fluxed by wet or dry techniques to strip the surface free of oxides to promote metallurgical as well as a mechanical bonding. In spraying a bore surface, the gun not only moves up and down along the length of the bore, but the gun rotates about an axis coincident or parallel to the bore axis as illustrated in FIG. 2. In this manner a uniformly thick coating sleeve 54 is deposited on the bore surface.

Upon receipt of the signal that spray head has entered an end zone, the power controller 52 drops the current level from about 65 amps to 45–50 amps, and drops the wire feed rate from about 165 inches per minute to 125–140 inches per minute.

To further facilitate a reduction in spray material in the reversal zone, the plasma gas pressure may be reduced from about 115 psi to about 90 psi by use of the gas/air supply controller 53. Varying the plasma gas pressure results in a reduction in the ionization temperature and thus reduces the speed at which melting of the wire will occur. At the same time, if the pressure of the secondary gas 19 is increased slightly from about 100 psi to 110 psi, the temperature at the melting zone of the wire tip 18 may also be slightly reduced facilitating a reduction of the volume of sprayed material.

The traverse mechanism speed rate may also be modified by speeding up the traverse rate in the reversal zone, but this is not easily accomplished or controlled with a ball-screw drive 35. A different traverse mechanism would have to be substituted, such as a linear motor driven slide, to facilitate precise velocity and momentum control.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A method of eliminating unevenness in pass-reversal electric arc thermal spray of a substrate surface having a pass length, comprising;

(a) uniformly thermally spraying said substrate surface by moving an electric arc thermal spray gun having a power supply, a wire feed rate supply, and a traverse mechanism, in a direction along the length of said substrate at constant spray parameters while using a first wire feed rate and a first current level for the power supply to the gun;

(b) when the movement of the gun enters a first end zone of the pass length, said zone being defined by the slowing down of the traverse mechanism to provide for direction reversal of the gun movement in the end zone, reducing the wire feed rate and current by about 25% to provide for a reduced volume of spray material;

(c) after the direction of the gun movement has reversed, and said gun exits from the end zone in the opposite direction, increasing the current and wire feed rates back to the first levels; and (d) repeating steps (b) and (c) as the gun is moved to enter other or repeated end zones of the pass length thereby producing a uniform thickness of the multi-layered spray material throughout the coating.

2. The method as in claim 1, in which the reduction of current and wire feed rate of step (b) results in less spray particle volume and less spray particle temperature during spraying deposition.

3. The method as in claim 1, in which said substrate surface is caustically cleansed and fluxed prior to step (a).

4. The method as in claim 1, in which said pass length has a width of about 11 inches and a length of about 5.0 inches.

5. The method as in claim 1, in which said first wire feed rate is about 165 inches per minute and said first current level is about 65 amps.

* * * * *